US009022724B2

(12) United States Patent
Liu

(10) Patent No.: US 9,022,724 B2
(45) Date of Patent: May 5, 2015

(54) ANTI-VIBRATION SERIAL FAN STRUCTURE

(75) Inventor: Wen-Hao Liu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 643 days.

(21) Appl. No.: 13/364,301

(22) Filed: Feb. 1, 2012

(65) Prior Publication Data

US 2013/0195622 A1 Aug. 1, 2013

(51) Int. Cl.
*F04D 29/66* (2006.01)
*F04D 19/00* (2006.01)
*F04D 29/64* (2006.01)

(52) U.S. Cl.
CPC ..... *F04D 19/007* (2013.01); *F04D 29/646* (2013.01); *F04D 29/668* (2013.01)

(58) Field of Classification Search
CPC ... F04D 19/007; F04D 29/522; F04D 29/644; F04D 29/646; F04D 29/688
USPC ..... 415/60, 66, 68, 220, 223, 213.1, 214.1; 361/695
See application file for complete search history.

(56) References Cited

U.S. PATENT DOCUMENTS

| | | | | |
|---|---|---|---|---|
| 6,662,411 | B2 * | 12/2003 | Rubenstein et al. | 24/453 |
| 7,227,748 | B2 * | 6/2007 | Garnett | 361/679.31 |
| 2003/0161103 | A1 * | 8/2003 | Wrycraft et al. | 361/695 |
| 2005/0106026 | A1 * | 5/2005 | Oosawa et al. | 416/198 R |
| 2006/0083608 | A1 * | 4/2006 | Sun | 415/199.4 |
| 2007/0059155 | A1 * | 3/2007 | Ishihara et al. | 415/60 |
| 2008/0008576 | A1 * | 1/2008 | Hong et al. | 415/68 |
| 2009/0111372 | A1 * | 4/2009 | Hsu et al. | 454/190 |
| 2010/0020493 | A1 * | 1/2010 | Lee et al. | 361/695 |

* cited by examiner

*Primary Examiner* — Nathaniel Wiehe
*Assistant Examiner* — Eldon Brockman

(57) ABSTRACT

An anti-vibration serial fan structure includes a first frame having a first assembling side and a second frame having a second assembling for connecting to the first assembling side. The first assembling side is provided with at least one mounting post or mounting hole and at least one male or female connector. The second assembling side is correspondingly provided with at least one mounting hole or mounting post and at least one female or male connector. The male connector has a certain degree of elasticity, so that the engaged male and female connectors provide a vibration-absorbing effect to save additional cushioning elements, enabling the serial fan structure to have lowered assembling cost and minimized defects in assembling.

19 Claims, 12 Drawing Sheets

ANTI-VIBRATION SERIAL FAN STRUCTURE

FIELD OF THE INVENTION

The present invention relates to a serial fan structure, and more particularly to an anti-vibration serial fan structure that includes a plurality of fan frames axially serially connected to one another through engagement of at least one elastic male connector with at least one female connector separately correspondingly provided on two adjacent fan frames, so that the serial fan provides anti-vibration effect without the need of additional cushioning or vibration-absorbing elements to thereby save assembling cost and minimize assembling defects.

BACKGROUND OF THE INVENTION

Due to the quick progress and development in the information technological field, the currently available electronic products all are designed to have high performance, high frequency, high operating speed, and minimized weight, thickness and volume. On the other hand, these electronic products also generate more and more heat during operation thereof. Since the high amount of heat produced during operation would adversely affect the reliability and the service life of the electronic products, it has become an important issue as how to remove the produced heat from the electronic products.

Presently, cooling fans are widely employed as a device to remove the operation-produced heat from the electronic products. Almost every electronic product is internally provided with a fan for keeping the electronic product within a preset working temperature range. However, it is possible one single fan does not provide sufficient air flow to ensure good heat dissipation effect of the electronic product. To enable enhanced heat dissipation, a plurality of fans may be serially connected to form a serial fan for drawing in increased air volume and producing increased air flows. In using the serial fan, a user might increase the fan's rotating speed to obtain upgraded heat dissipation efficiency. The serial fan operating at the increased rotating speed will vibrate and produce noise due to a resonant effect between the serially connected fan frames. This condition will cause reduced stability of the electronic product.

FIG. 1 shows a prior art serial fan, which includes a first fan 10 and a second fan 11 serially axially connected to each other. When the first and the second fan 10, 11 are caused to rotate at an increased speed in order to meet the requirement for heat dissipation, the two fans 10, 11 will vibrate and produce noise due to a resonant effect between the two fans 10, 11. To overcome this undesirable condition, a vibration-absorbing member 12 is disposed between the two fans 10, 11 for absorbing the vibration produced by the first and the second fan 10, 11 during operation thereof. The additional vibration-absorbing member 12 would increase the assembling cost of the serial fan and tends to cause defects of the serial fan when being poorly assembled to the two fans 10, 11.

In brief, the prior art serial fan with additional vibration-absorbing member has the following disadvantages: (1) requiring increased assembling cost; and (2) tending to have defects due to poorly assembled vibration-absorbing member.

It is therefore tried by the inventor to develop an improved anti-vibration serial fan to overcome the drawbacks in the prior art serial fan.

SUMMARY OF THE INVENTION

A primary object of the present invention is to provide a serial fan structure that provides upgraded anti-vibration effect.

Another object of the present invention is to provide a serial fan structure that enables lowered assembling cost and minimized assembling defects.

To achieve the above and other objects, the serial fan structure according to the present invention includes a first frame having a first assembling side, and a second frame having a second assembling side facing toward the first frame for connecting to the first assembling side.

The first assembling side is provided with at least one mounting hole and/or at least one mounting post, as well as at least one male connector and/or at least one female connector.

The second assembling side is provided with at least one mounting post and/or at least one mounting hole corresponding to the mounting hole and/or the mounting post on the first assembling side, as well as at least one female connector and/or at least one male connector corresponding to the male connector and/or the female connector on the first assembling side.

When the first frame is serially assembled to the second frame, the mounting post/hole on the first assembling side engages with the mounting hole/post on the second assembling side, and the male/female connector on the first assembling side engages with the female/male connector on the second assembling side to form a fully assembled serial fan.

The male connector is made to have a certain degree of elasticity. Through the engagement of the male connector with the female connector, it is possible to provide the serial fan with an anti-vibration effect without the need of providing additional cushioning or vibration-absorbing elements between the first and the second assembling side. Therefore, the fully assembled serial fan of the present invention has the advantages of providing good anti-vibration effect, lowered assembling cost, and minimized defects in assembling.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
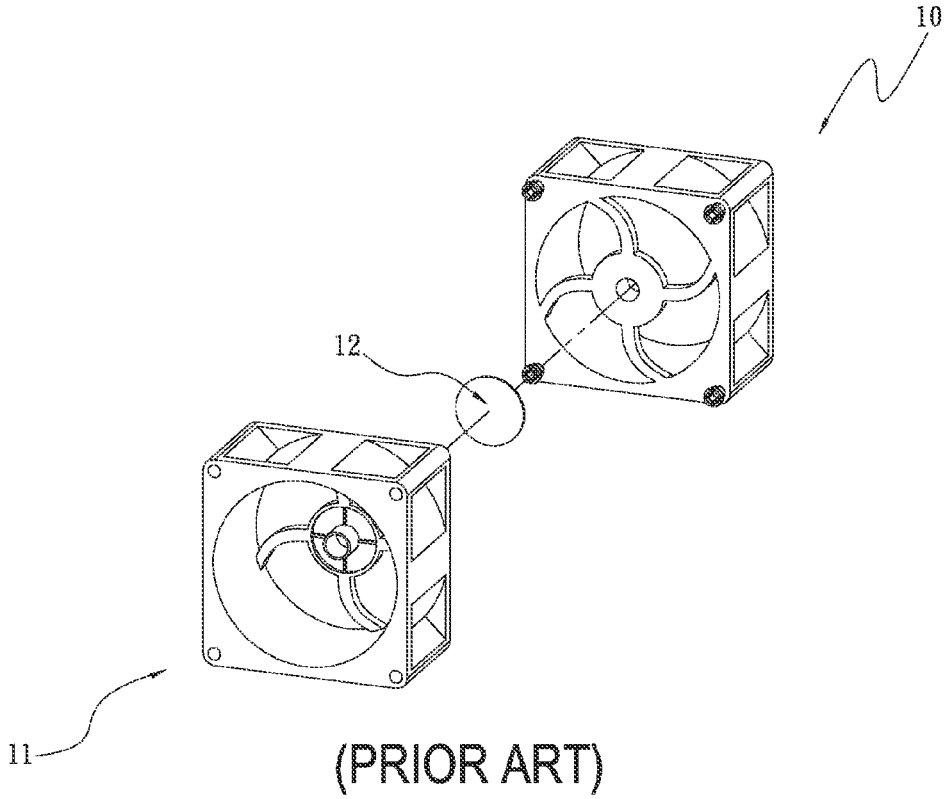
(PRIOR ART) Fig.1
FIG. 1 is an exploded perspective view of a conventional serial fan structure.

The present invention will now be described with some preferred embodiments thereof and with reference to the accompanying drawings. For the purpose of easy to understand, elements that are the same in the preferred embodiments are denoted by the same reference numerals.

A serial fan structure 2 according to the present invention includes a first frame 20 having a first assembling side 201, a second frame 21 having a second assembling side 210 facing toward the first frame 20 for connecting to the first assembling side 201. On the first assembling side 201, there are provided at least one mounting hole 22 or at least one mounting post 23 and at least one male connector 24 or at least one female connector 25. On the second assembling side 210, there are provided at least one mounting post 23 or at least one mounting hole 22 corresponding to the mounting hole 22 or the mounting post 23 on the first assembling side 201, as well as at least one female connector 25 or at least one male connector 24 corresponding to the male connector 24 or the female connector 25 on the first assembling side 201. The male connector 24 and the female connector 25 are arranged in the vicinity of one mounting post 23 or one mounting hole 22.

Figure 2A:
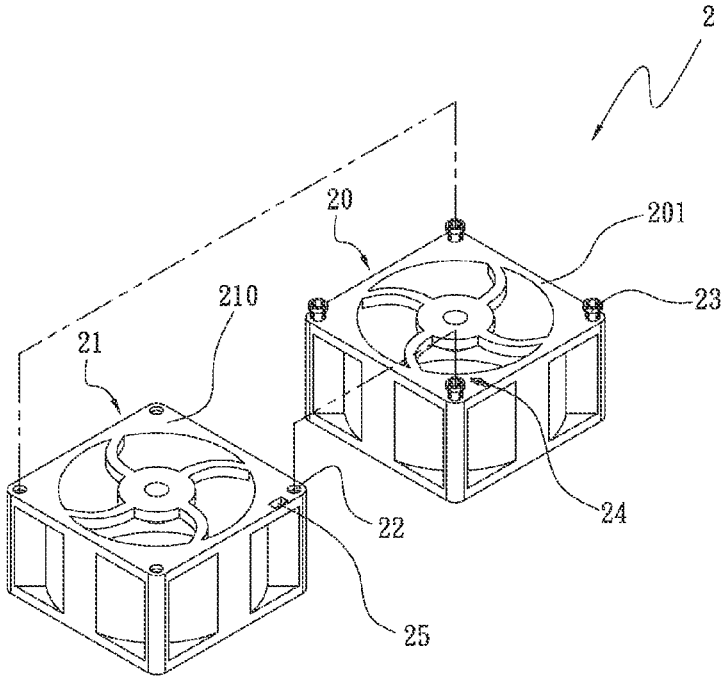
FIG. 2A is an exploded perspective view of a serial fan structure according to a first embodiment of the present invention.

Please refer to FIG. 2A, in which a serial fan structure 2 according to a first embodiment of the present invention is shown. In the first embodiment, the first frame 20 is provided on the first assembling side 201 with four mounting posts 23 and one male connector 24, and the second frame 21 is provided on the second assembling side 210 with four mounting holes 22 and one female connector 25 corresponding to the mounting posts 23 and the male connector 24 on the first frame 20, respectively. The mounting posts 23 are hollow cylindrical posts. The male connector 24 is arranged in the vicinity of one of the four mounting posts 23 on the first assembling side 201, and the female connector 25 is arranged in the vicinity of one of the four mounting holes 22 on the second assembling side 210. When the first frame 20 and the second frame 21 are assembled to each other, the mounting posts 23 on the first assembling side 201 are correspondingly inserted into the mounting holes 22 on the second assembling side 210, and the male connector 24 is engaged with the female connector 25, so that the first and the second frame 20, 21 are serially connected to form the serial fan structure 2. The male connector 24 is configured to have a certain degree of elasticity and can serve as an elastic support to provide good vibration-absorbing and constant holding effect. Therefore, no additional cushioning or vibration-absorbing elements are needed between the first and the second frame 20, 21, enabling the serial fan structure of the present invention to be manufactured at lowered assembling cost and with minimized defects in assembling.

Figure 2B:
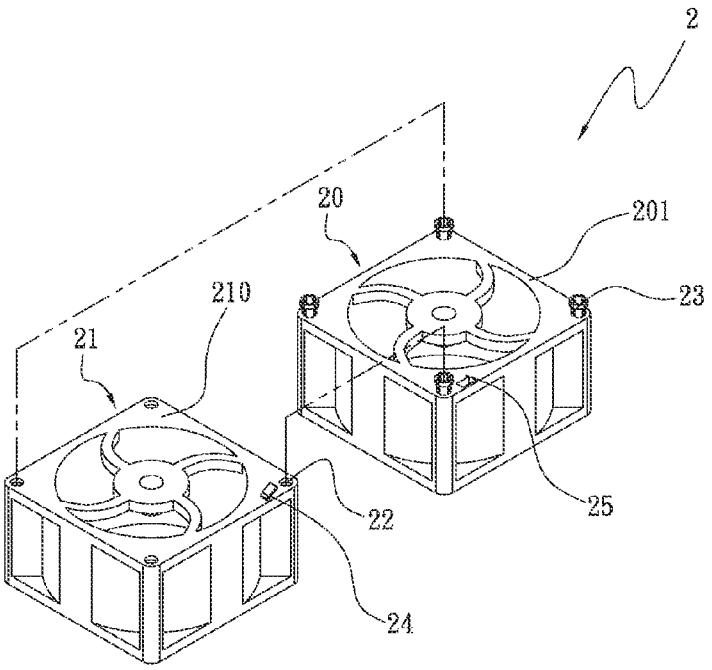
FIG. 2B is a variant of the serial fan structure according to the first embodiment of the present invention.

FIG. 2B shows a variant of the serial fan structure according to the first embodiment of the present invention. A major difference between the variant and the first embodiment is that, in the variant, the first assembling side 201 is provided with four mounting posts 23 and one female connector 25 while the second assembling side 210 is provided with four mounting holes 22 and one male connector 24. When the first frame 20 and the second frame 21 are assembled to each other, the mounting posts 23 on the first assembling side 201 are correspondingly inserted into the mounting holes 22 on the second assembling side 210, and the female connector 25 is engaged with the male connector 24, so that the first and the second frame 20, 21 are serially connected to form the serial fan structure 2. With the female connector 25 on the first frame 20 engaged with the elastic male connector 24 on the second frame 21, the fully assembled serial fan structure 2 can equally have good anti-vibration effect without the need of providing additional cushioning or vibration-absorbing elements.

According to the present invention, the male connector 24 and the female connector 25 can be provided in the vicinity of any corner of the first and the second assembling side 201, 210 according to actual need.

Figure 3A:
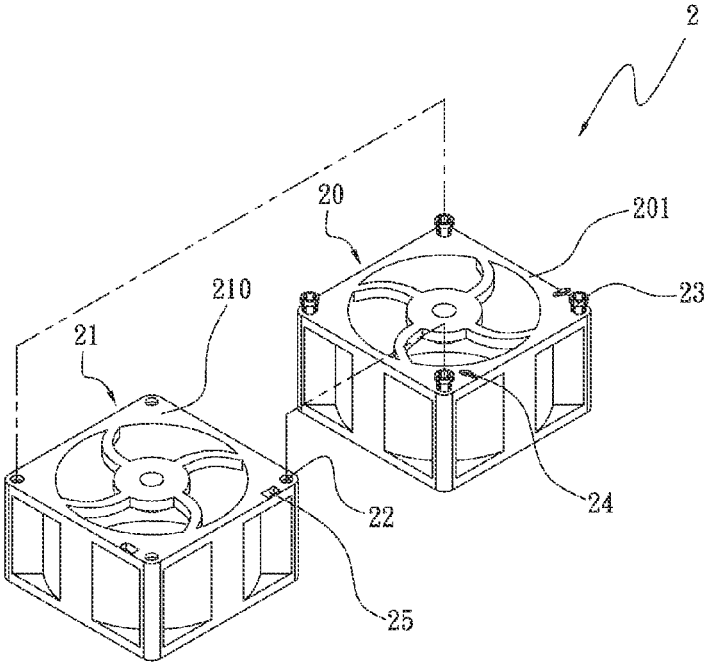
FIG. 3A is an exploded perspective view of a serial fan structure according to a second embodiment of the present invention.

Please refer to FIG. 3A that is an exploded perspective view of a serial fan structure 2 according to a second embodiment of the present invention. As shown, the second embodiment is generally structurally similar to the first embodiment, except that two male connectors 24 are provided on the first assembling side 201 of the first frame 20 while two female connectors 25 are provided on the second assembling side 210 of the second frame 21. In the second embodiment, the two male connectors 24 are arranged in the vicinity of two adjacent corners of the first assembling side 201, and the two female connectors 25 are correspondingly arranged in the vicinity of two adjacent corners of the second assembling side 210.

When the first frame 20 and the second frame 21 are assembled to each other, the mounting posts 23 on the first assembling side 201 are inserted into the mounting holes 22 on the second assembling side 210, and the male connectors 24 are correspondingly engaged with the female connectors 25, so that the first and the second frame 20, 21 are serially connected to form the serial fan structure 2. Through the engagement of the elastic male connectors 24 with the female connectors 25, the serial fan structure 2 can equally have good anti-vibration effect without the need of providing additional cushioning or vibration-absorbing elements between the first and the second frame 20, 21, enabling the serial fan structure 2 to be manufactured at lowered assembling cost and with minimized defects in assembling.

Figure 3B:
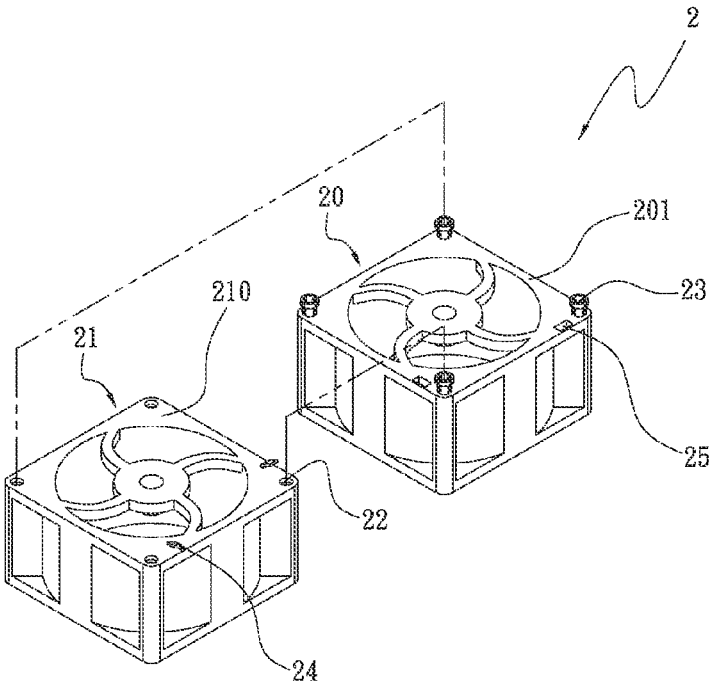
FIG. 3B is a variant of the serial fan structure according to the second embodiment of the present invention.

FIG. 3B shows a variant of the serial fan structure 2 according to the second embodiment of the present invention. A major difference between the variant and the second embodiment is that, in the variant, the first assembling side 201 is provided with four mounting posts 23 and two female connectors 25 while the second assembling side 210 is provided with four mounting holes 22 and two male connectors 24. When the first frame 20 and the second frame 21 are assembled to each other, the mounting posts 23 on the first assembling side 201 are correspondingly inserted into the mounting holes 22 on the second assembling side 210, and the female connectors 25 are correspondingly engaged with the male connectors 24, so that the first and the second frame 20, 21 are serially connected to form the serial fan structure 2. With the female connectors 25 on the first frame 20 engaged with the elastic male connectors 24 on the second frame 21, the fully assembled serial fan structure 2 can equally have good anti-vibration effect, lowered assembling cost, and minimized defects in assembling.

Figure 4A:
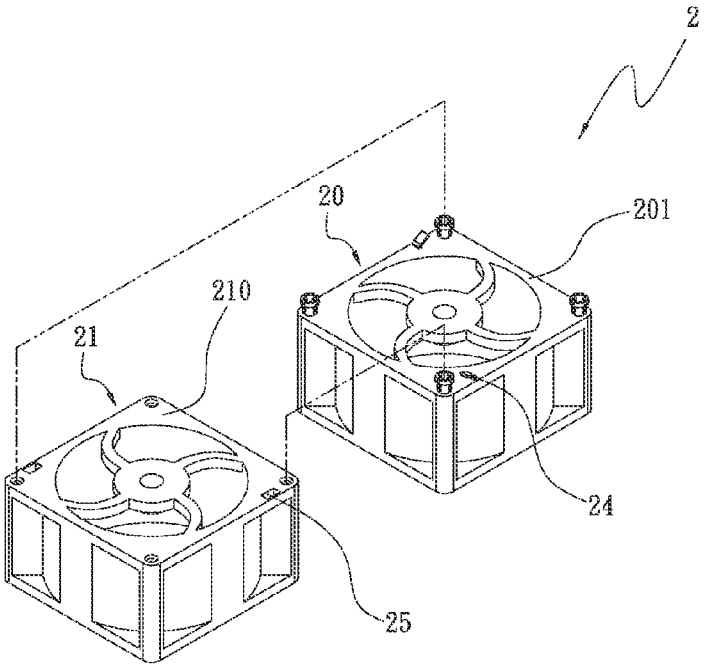
FIG. 4A is an exploded perspective view of a serial fan structure according to a third embodiment of the present invention.
Figure 4B:
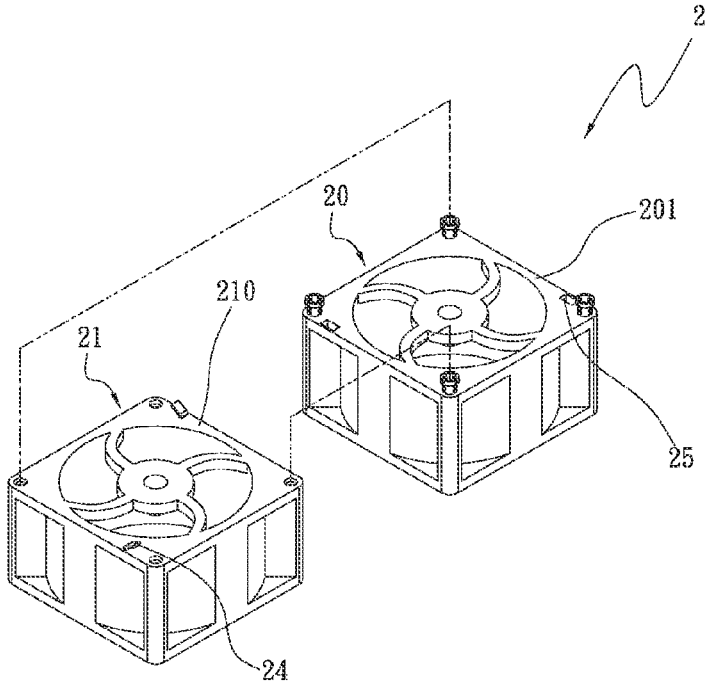
FIG. 4B is a variant of the serial fan structure according to the third embodiment of the present invention.

FIG. 4A is an exploded perspective view of a serial fan structure 2 according to a third embodiment of the present invention. As shown, the third embodiment is generally structurally similar to the second embodiment, except that the two male connectors 24 are arranged in the vicinity of two diagonally opposite corners of the first assembling side 201 and the two female connectors 25 are arranged in the vicinity of two diagonally opposite corners of the second assembling side 210 corresponding to the male connectors 24 on the first assembling side 201. FIG. 4B is a variant of the third embodiment, and the major difference between the variant and the third embodiment is that, in the variant, the first assembling side 201 is provided with two female connectors 25 while the second assembling side 210 is provided with two male connectors 24.

When the first and the second frame 20, 21 in the third embodiment are assembled to each other, the serial fan structure 2 can equally have good anti-vibration effect, lowered assembling cost, and minimized defects in assembling.

Figure 5A:
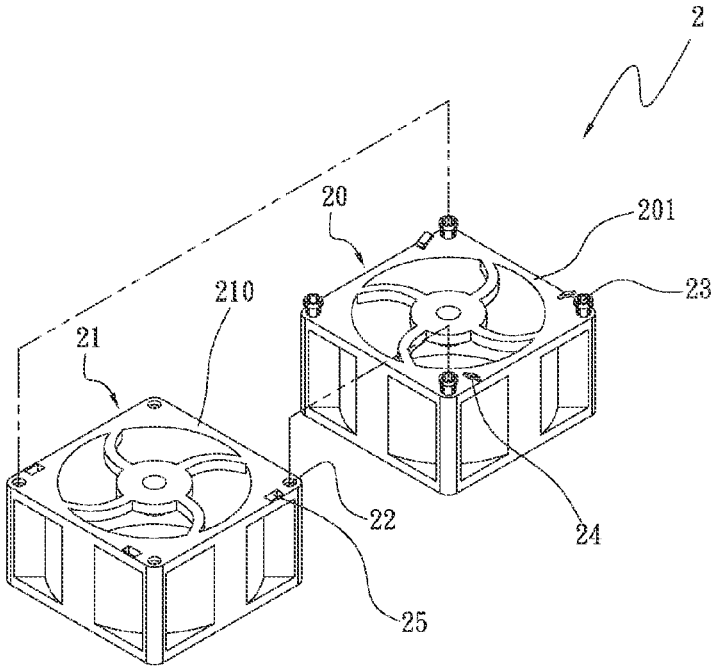
FIG. 5A is an exploded perspective view of a serial fan structure according to a fourth embodiment of the present invention.

Please refer to FIG. 5A that is an exploded perspective view of a serial fan structure 2 according to a fourth embodiment of the present invention. As shown, the fourth embodiment is generally structurally similar to the first embodiment, except that three male connectors 24 are provided on the first assembling side 201 of the first frame 20 while three female connectors 25 are provided on the second assembling side 210 of the second frame 21. In the fourth embodiment, the three male connectors 24 and the three female connectors 25 are separately arranged in the vicinity of any three corners of the first assembling side 201 and the second assembling side 210, respectively.

When the first frame 20 and the second frame 21 are assembled to each other, the mounting posts 23 on the first assembling side 201 are inserted into the mounting holes 22 on the second assembling side 210, and the male connectors 24 are correspondingly engaged with the female connectors 25, so that the first and the second frame 20, 21 are serially connected to form the serial fan structure 2. Through the engagement of the elastic male connectors 24 with the female connectors 25, the fully assembled serial fan structure 2 in the fourth embodiment can equally have good anti-vibration effect without the need of providing additional cushioning or vibration-absorbing elements between the first and the second frame 20, 21, and accordingly has lowered assembling cost and minimized defects in assembling.

Figure 5B:
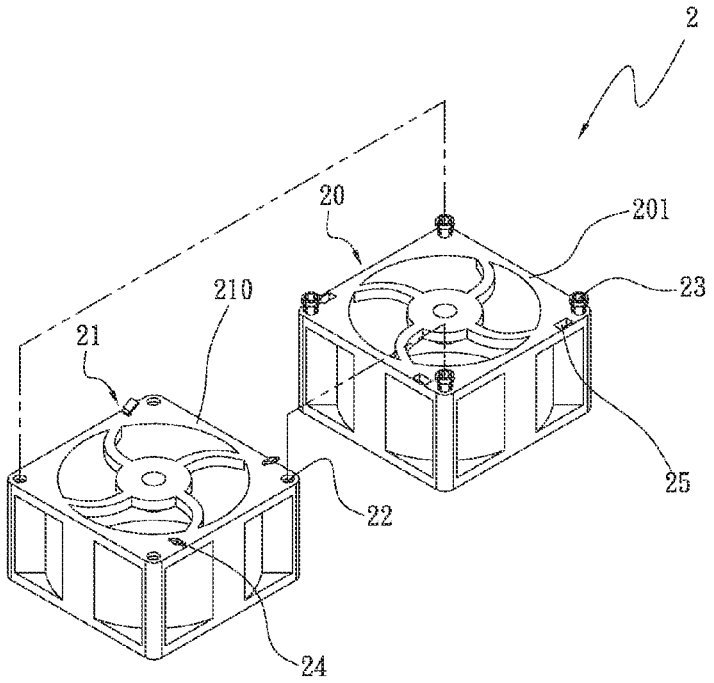
FIG. 5B is a variant of the serial fan structure according to the fourth embodiment of the present invention.

FIG. 5B shows a variant of the fourth embodiment. The major difference between the variant and the fourth embodiment is that, in the variant, the first assembling side 201 is provided with three female connectors 25 while the second assembling side 210 is provided with three male connectors 24. When the first frame 20 and the second frame 21 are assembled to each other, the mounting posts 23 on the first assembling side 201 are correspondingly inserted into the mounting holes 22 on the second assembling side 210, and the female connectors 25 are correspondingly engaged with the male connectors 24, so that the first and the second frame 20, 21 are serially connected to form the serial fan structure 2. With the female connectors 25 on the first frame 20 engaged with the elastic male connectors 24 on the second frame 21, the serial fan structure 2 according to the variant of the fourth embodiment can equally have good anti-vibration effect.

Figure 6A:
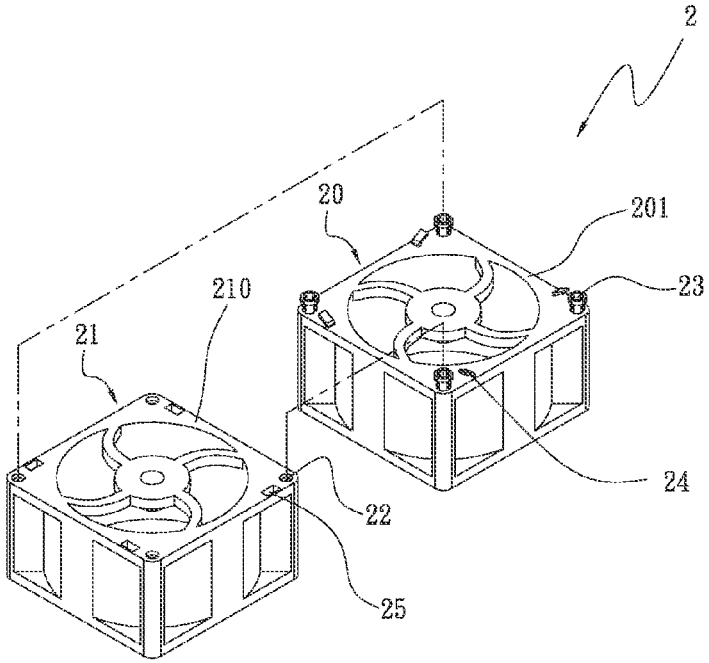
FIG. 6A is an exploded perspective view of a serial fan structure according to a fifth embodiment of the present invention.

Please refer to FIG. 6A that is an exploded perspective view of a serial fan structure 2 according to a fifth embodiment of the present invention. As shown, the fifth embodiment is generally structurally similar to the first embodiment, except that four male connectors 24 are provided on the first assembling side 201 of the first frame 20 while four female connectors 25 are provided on the second assembling side 210 of the second frame 21. In the fifth embodiment, the four male connectors 24 and the four female connectors 25 are arranged in the vicinity of four corners of the first assembling side 201 and the second assembling side 210, respectively.

When the first frame 20 and the second frame 21 are assembled to each other, the mounting posts 23 on the first assembling side 201 are inserted into the mounting holes 22 on the second assembling side 210, and the male connectors 24 are correspondingly engaged with the female connectors 25, so that the first and the second frame 20, 21 are serially connected to form the serial fan structure 2. Through the engagement of the elastic male connectors 24 with the female connectors 25, the fully assembled serial fan structure 2 in the fifth embodiment can equally have good anti-vibration effect without the need of providing additional cushioning or vibration-absorbing elements between the first and the second frame 20, 21, and accordingly has lowered assembling cost and minimized defects in assembling.

Figure 6B:
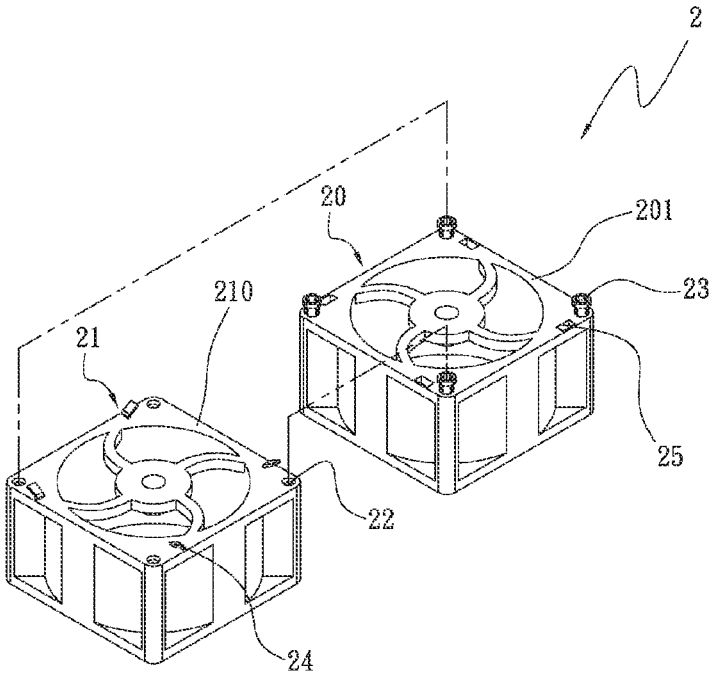
FIG. 6B is a variant of the serial fan structure according to the fifth embodiment of the present invention.

FIG. 6B shows a variant of the fifth embodiment. The major difference between the variant and the fifth embodiment is that, in the variant, the first assembling side 201 is provided with four female connectors 25 while the second assembling side 210 is provided with four male connectors 24. When the first frame 20 and the second frame 21 are assembled to each other, the mounting posts 23 on the first assembling side 201 are correspondingly inserted into the mounting holes 22 on the second assembling side 210, and the female connectors 25 are correspondingly engaged with the male connectors 24, so that the first and the second frame 20, 21 are serially connected to form the serial fan structure 2. With the female connectors 25 on the first frame 20 engaged with the elastic male connectors 24 on the second frame 21, the fully assembled serial fan structure 2 can equally have good anti-vibration effect, lowered assembling cost, and minimized defects in assembling.

Figure 7A:
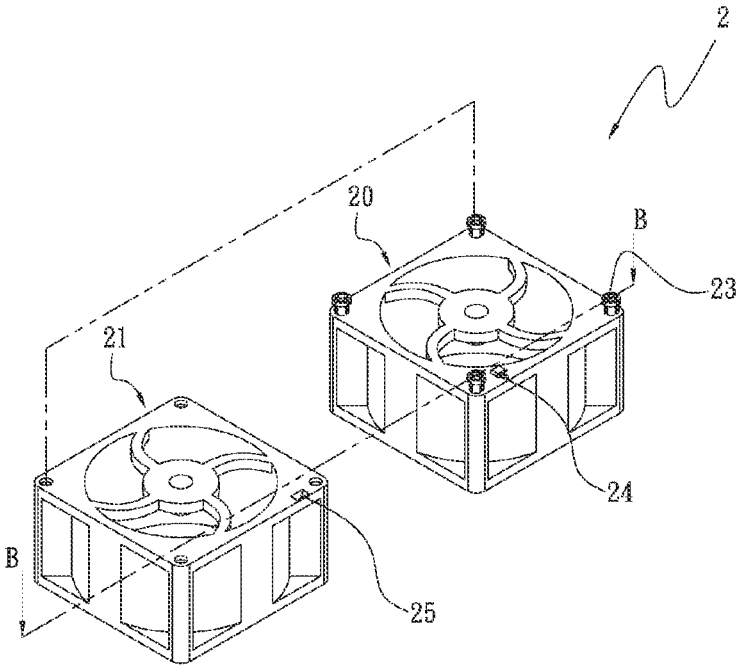
FIG. 7A is an exploded perspective view of a serial fan structure according to a sixth embodiment of the present invention.
Figure 7B:
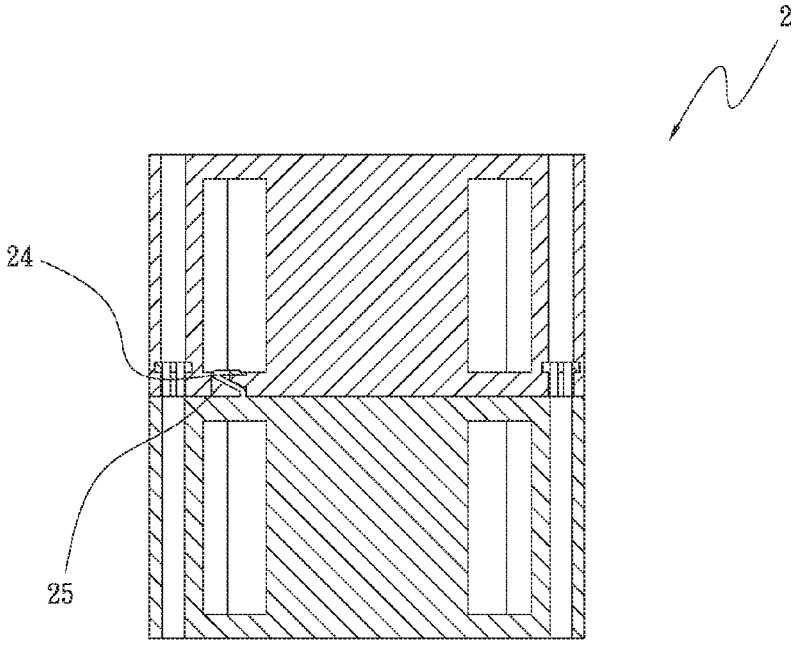
FIG. 7B is a sectional view taken along line B-B of FIG. 7A.

FIG. 7A is an exploded perspective view of a serial fan structure 2 according to a sixth embodiment of the present invention, and FIG. 7B is a sectional view taken along line B-B of FIG. 7A. As shown, the sixth embodiment is generally structurally similar to the first embodiment, except that the male connector 24 is in the form of a barb. Through the engagement of the barb-shaped male connector 24 with the female connector 25, the first and the second frame 20, 21 can be more firmly assembled together, so that the fully assembled serial fan structure 2 has further enhanced structure that enables reduced noise during operation thereof.

Figure 8:
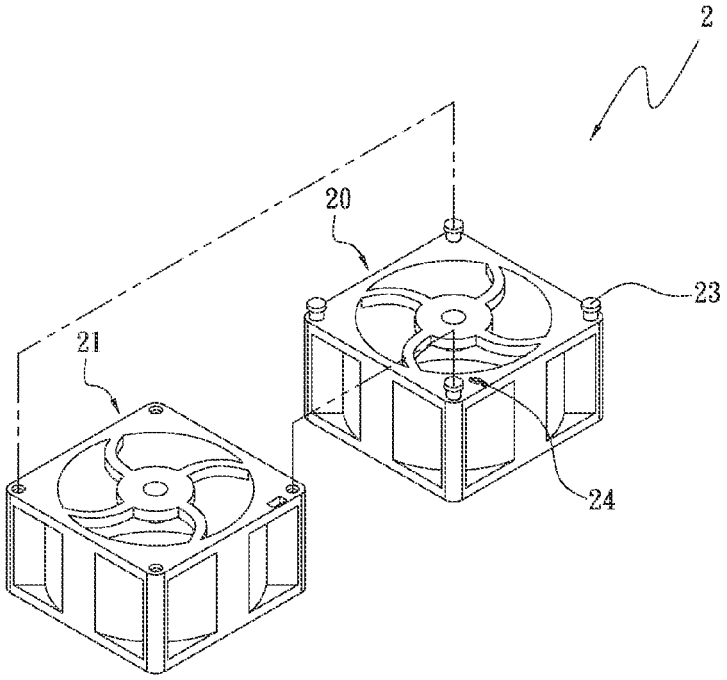
FIG. 8 is an exploded perspective view of a serial fan structure according to a seventh embodiment of the present invention.

Please refer to FIG. 8 that is an exploded perspective view of a serial fan structure 2 according to a seventh embodiment of the present invention. As shown, the seventh embodiment is generally structurally similar to the first embodiment, except that, in the seventh embodiment, the mounting posts 23 are solid cylindrical posts. While the solid mounting posts 23 illustrated in the seventh embodiment are provided on the first frame 20, it is understood they can be otherwise provided on the second frame 21. Further, in the seventh embodiment, the male connector 24 is made of a polymeric material, a carbon fiber material, or an elastic material.

Figure 9:
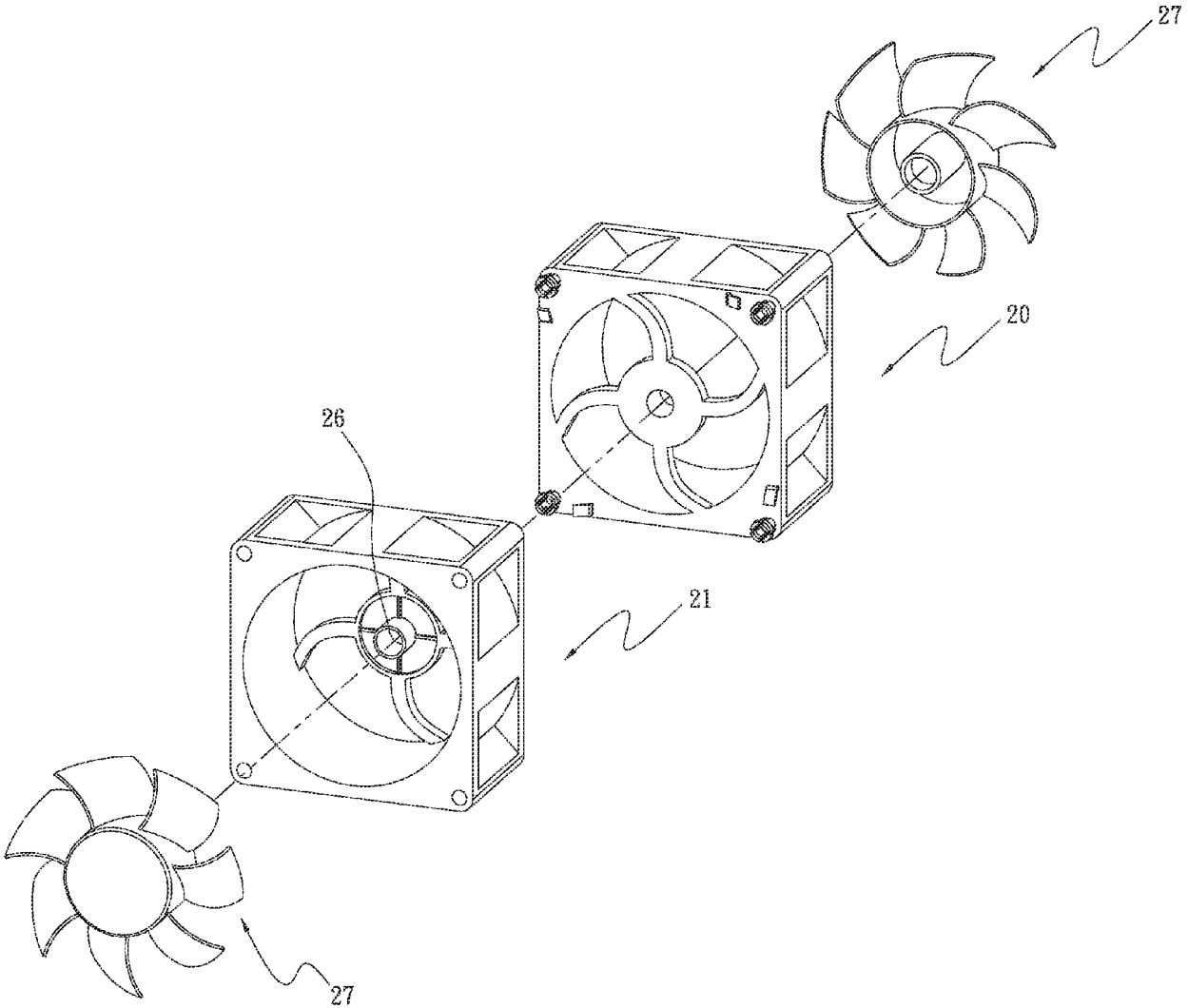
FIG. 9 is an exploded perspective view of a serial fan structure according to an eighth embodiment of the present invention.

FIG. 9 is an exploded perspective view of a serial fan structure according to an eighth embodiment of the present invention. As shown, the serial fan structure in the eighth embodiment is generally structurally similar to the previous embodiments, and the first frame 20 and the second frame 21 thereof respectively have a rotary shaft supporting base 26 and a blade assembly 27 rotatably connected to the rotary shaft supporting base 26. With the above arrangements, the first and the second frame 20, 21 can be serially assembled to each other to form a serial fan structure.

Alternatively, according to the present invention, the serial fan structure 2 includes a first frame 20 having a first assembling side 201, a second frame 21 having a second assembling side 210 facing toward the first frame 20 for assembled to the first assembling side 201. The first assembling side 201 is provided with at least one mounting hole 22 and at least one mounting post 23 as well as at least one male connector 24 and at least one female connector 25; and the second assembling side 210 is correspondingly provided with at least one mounting post 23 and at least one mounting hole 22 as well as at least one female connector 25 and at least one male connector 24. And, the male connector 24 and the female connector 25 on each of the first and the second assembling side 201, 210 are arranged in the vicinity of the mounting post 23 and the mounting hole 22.

Figure 10A:
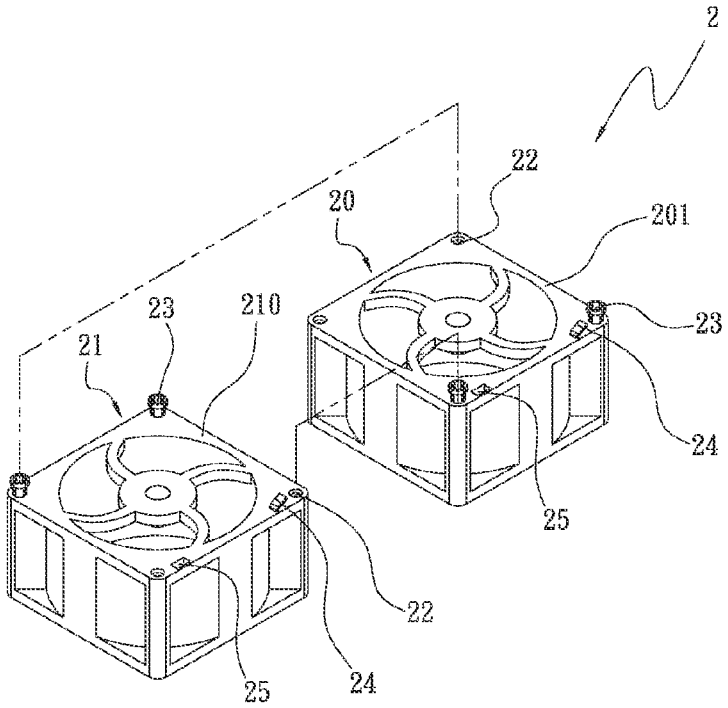
FIG. 10A is an exploded perspective view of a serial fan structure according to a ninth embodiment of the present invention.

FIG. 10A is an exploded perspective view of a serial fan structure 2 according to a ninth embodiment of the present invention. In the ninth embodiment, the first assembling side 201 of the first frame 20 and the second assembling side 210 of the second frame 21 are respectively and correspondingly provided with two mounting posts 23 and two mounting holes 22 as well as one male connector 24 and one female connector 25. The male connector 24 and the female connector 25 are separately arranged in the vicinity of two adjacent corners of the first and of the second assembling side 201, 210. When the first frame 20 and the second frame 21 are assembled to each other, the mounting posts 23 and the mounting holes 22 on the first assembling side 201 are correspondingly inserted into the mounting holes 22 and the mounting posts 23 on the second assembling side 210, and the male connector 24 and the female connector 25 on the first assembling side 201 are correspondingly engaged with the female connector 25 and the male connector 24 on the second assembling side 210. Thus, the fully assembled serial fan structure 2 in the ninth embodiment has good structural strength to eliminate vibration during operation thereof without the need of providing additional cushioning or vibration-absorbing elements between the first and the second frame 20, 21, and accordingly has lowered assembling cost and minimizes defects in assembling.

Figure 10B:
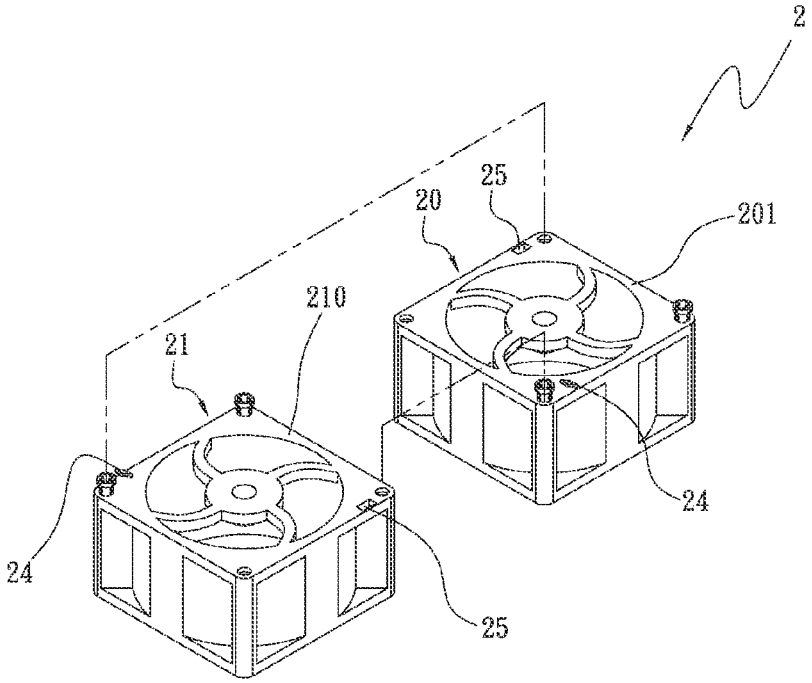
FIG. 10B is a variant of the serial fan structure according to the ninth embodiment of the present invention.

FIG. 10B shows a variant of the serial fan structure 2 according to the ninth embodiment of the present invention. A major difference between the variant and the ninth embodiment is that, in the variant, the male connector 24 and the female connector 25 are separately arranged in the vicinity of two diagonally opposite corners of the first and of the second assembling side 201, 210. When the first frame 20 and the second frame 21 are assembled to each other, the fully assembled serial fan structure 2 can equally have good anti-vibration effect without the need of additional cushioning or vibration-absorbing elements.

Figure 11:
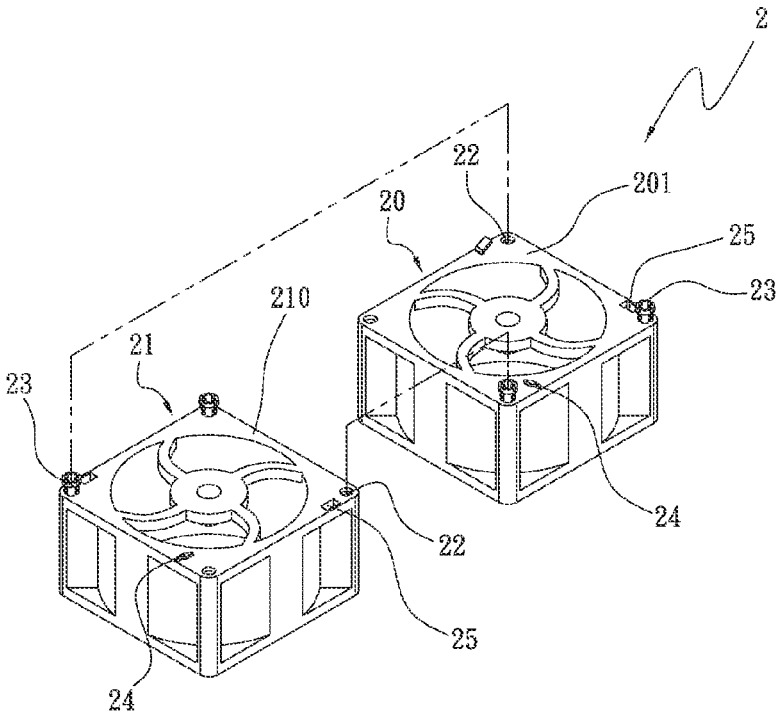
FIG. 11 is an exploded perspective view of a serial fan structure according to a tenth embodiment of the present invention.

FIG. 11 is an exploded perspective view of a serial fan structure 2 according to a tenth embodiment of the present invention. As shown, the tenth embodiment is generally structurally similar to the ninth embodiment, except that the first assembling side 201 of the first frame 20 has two male connectors 24 and one female connector 25 provided thereon while the second assembling side 210 of the second frame 21 has two female connectors 25 and one male connector 24 provided thereon. When the first frame 20 and the second frame 21 are assembled to each other, the fully assembled serial fan structure 2 according to the tenth embodiment also has good anti-vibration, lowered assembling cost, and minimized defects in assembling.

Figure 12:
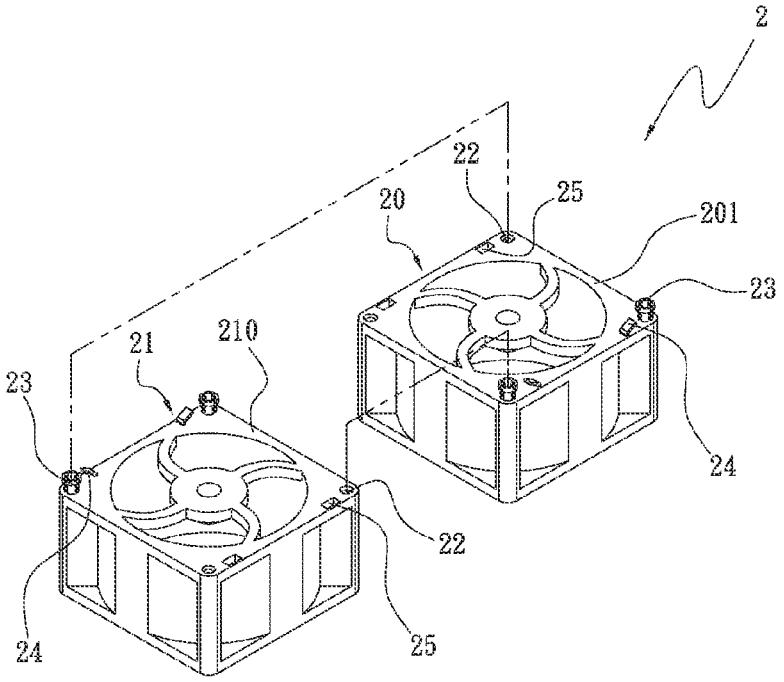
FIG. 12 is an exploded perspective view of a serial fan structure according to an eleventh embodiment of the present invention.

FIG. 12 is an exploded perspective view of a serial fan structure 2 according to an eleventh embodiment of the present invention. As shown, the eleventh embodiment is generally structurally similar to the ninth embodiment, except that the first assembling side 201 of the first frame 20 and the second assembling side 210 of the second frame 20 respectively have two male connectors 24 and two female connectors 25 provided thereon. When the first frame 20 and the second frame 21 are assembled to each other, the fully assembled serial fan structure 2 according to the eleventh embodiment also has good anti-vibration effect, lowered assembling cost, and minimized defects in assembling.

Figure 13:
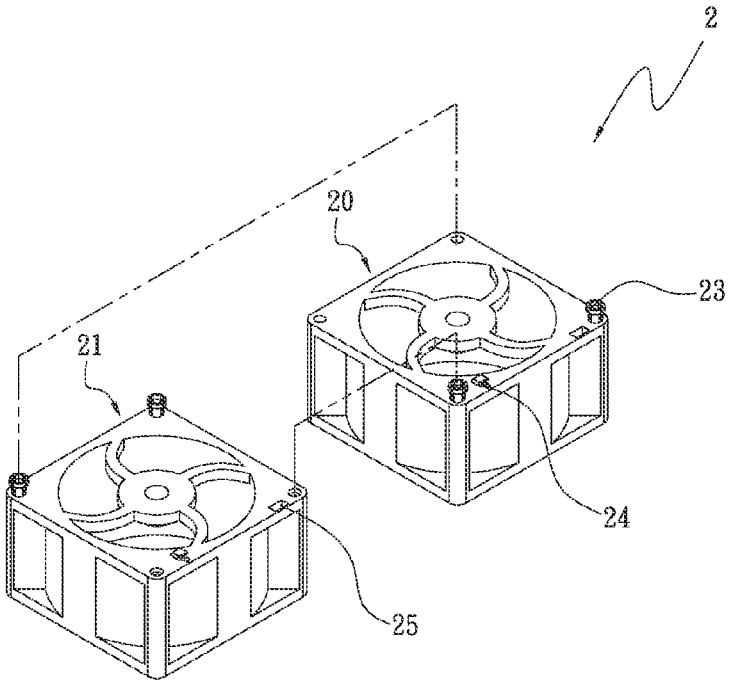
FIG. 13 is an exploded perspective view of a serial fan structure according to a twelfth embodiment of the present invention.

FIG. 13 is an exploded perspective view of a serial fan structure 2 according to a twelfth embodiment of the present invention. As shown, the twelfth embodiment is generally structurally similar to the ninth embodiment, except that the male connector 24 provided on the first and the second assembling side 201, 210 are respectively in the form of a barb. Through the engagement of the barb-shaped male connectors 24 with the female connectors 25, the first and the second frame 20, 21 can be more firmly assembled together, so that the fully assembled serial fan structure 2 according to the twelfth embodiment has further enhanced structure that enables reduced noise during operation of the serial fan structure 2.

Figure 14:
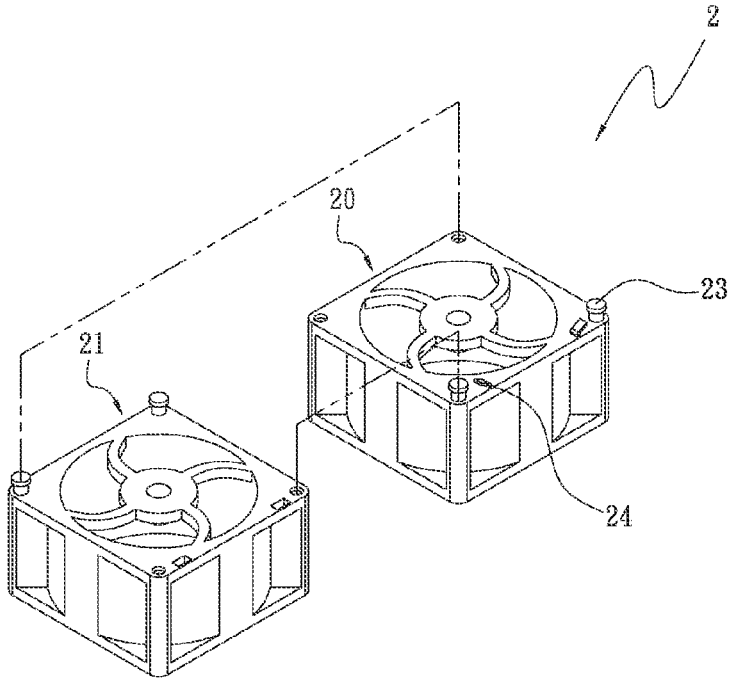
FIG. 14 is an exploded perspective view of a serial fan structure according to a thirteenth embodiment of the present invention.

Please refer to FIG. 14 that is an exploded perspective view of a serial fan structure 2 according to a thirteenth embodiment of the present invention. As shown, the thirteenth embodiment is generally structurally similar to the ninth embodiment, except that, in the thirteenth embodiment, the mounting posts 23 provided on the first frame 20 and the second frame 21 are solid cylindrical posts. Further, in the thirteenth embodiment, the male connectors 24 are made of a polymeric material, a carbon fiber material, or an elastic material.

Figure 15:
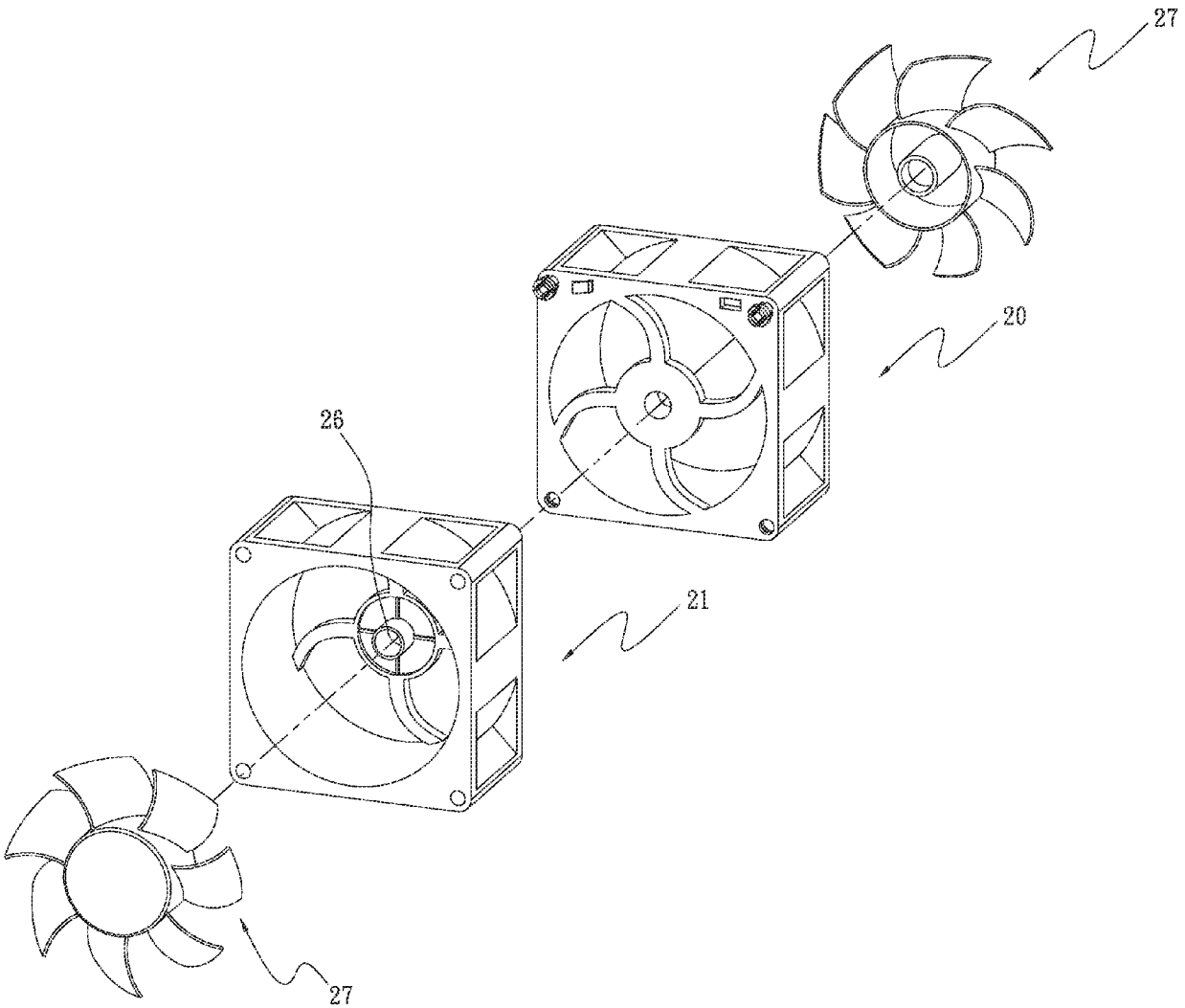
FIG. 15 is an exploded perspective view of a serial fan structure according to a fourteenth embodiment of the present invention.

Please refer to FIG. 15 that is an exploded perspective view of a serial fan structure according to a fourteenth embodiment of the present invention. As shown, the serial fan structure in the fourteenth embodiment is generally structurally similar to the ninth to the thirteenth embodiment, and the first frame 20 and the second frame 21 thereof respectively have a rotary shaft supporting base 26 and a blade assembly 27 rotatably connected to the rotary shaft supporting base 26. With the above arrangements, the first and the second frame 20, 21 can be serially assembled to each other to form a serial fan structure.

In summary, the serial fan structure of the present invention has the following advantages: (1) good anti-vibration effect; (2) lowered assembling cost; (3) minimized defects in assembling; and (4) reduced noise during operation of the serial fan structure.

The present invention has been described with some preferred embodiments thereof and it is understood that many changes and modifications in the described embodiments can be carried out without departing from the scope and the spirit of the invention that is intended to be limited only by the appended claims.

What is claimed is

1. An anti-vibration serial fan structure, comprising:

a first frame having a first assembling side, and the first assembling side being provided with at least one mounting hole or at least one mounting post as well as at least one male connector or at least one female connector; and a second frame having a second assembling side facing toward the first frame for connecting to the first assembling side; and the second assembling side being provided with at least one mounting post or at least one mounting hole corresponding to the mounting hole or the mounting post provided on the first assembling side, as well as at least one female connector or at least one male connector corresponding to the male connector or the female connector provided on the first assembling side, wherein the mounting post is selected from the group consisting of a hollow cylindrical post and a solid cylindrical post.

2. The serial fan structure as claimed in claim 1, wherein the at least one male connector or the at least one female connector provided on each of the first and the second assembling side is located in the vicinity of the at least one mounting hole or the at least one mounting post.

3. The serial fan structure as claimed in claim 1, wherein the at least one male connector or the at least one female connector provided on each of the first and the second assembling side is located in the vicinity of one corner of the first and of the second assembling side.

4. The serial fan structure as claimed in claim 1, wherein, two male or two female connectors are provided on each of the first and the second assembling side, and the two male or female connectors are separately located in the vicinity of two adjacent corners of the first and of the second assembling side.

5. The serial fan structure as claimed in claim 1, wherein two male or two female connectors are provided on each of the first and the second assembling side, and the two male or female connectors are separately located in the vicinity of two diagonally opposite corners of the first and of the second assembling side.

6. The serial fan structure as claimed in claim 1, wherein three male or three female connectors are provided on each of the first and the second assembling side, and the three male or female connectors are separately located in the vicinity of three corners of the first and of the second assembling side.

7. The serial fan structure as claimed in claim 1, wherein four male or four female connectors are provided on each of the first and the second assembling side, and the four male or female connectors are separately located in the vicinity of four corners of the first and of the second assembling side.

8. The serial fan structure as claimed in claim 1, wherein the male connector is made of a material selected from the group consisting of a polymeric material, a carbon fiber material, and an elastic material.

9. The serial fan structure as claimed in claim 1, wherein the male connector is in the form of a barb.

10. The serial fan structure as claimed in claim 1, wherein the first and the second frame respectively have a rotary shaft supporting base and a blade assembly rotatably connected to the rotary shaft supporting base.

11. A serial fan structure, comprising:

a first frame having a first assembling side, and the first assembling side being provided with at least one mounting hole and at least one mounting post as well as at least one male connector and at least one female connector; and a second frame having a second assembling side facing toward the first frame for assembled to the first assembling side; and the second assembling side being provided with at least one mounting post and at least one mounting hole corresponding to the mounting hole and the mounting post provided on the first assembling side, as well as at least one female connector and at least one male connector corresponding to the male connector and the female connector provided on the first assembling side, wherein the mounting post is selected from the group consisting of a hollow cylindrical post and a solid cylindrical post.

12. The serial fan structure as claimed in claim 11, wherein the at least one male connector and the at least one female connector provided on each of the first and the second assembling side are respectively located in the vicinity of the at least one mounting hole or the at least one mounting post.

13. The serial fan structure as claimed in claim 11, wherein the at least one male connector and the at least one female connector provided on each of the first and the second assembling side are located in the vicinity of two diagonally opposite corners of the first and of the second assembling side.

14. The serial fan structure as claimed in claim 11, wherein the at least one male connector and the at least one female connector provided on each of the first and the second assembling side are located in the vicinity of two adjacent corners of the first and of the second assembling side.

15. The serial fan structure as claimed in claim 11, wherein the at least one male connector and the at least one female connector provided on each of the first and the second assembling side are located in the vicinity of three corners of the first and of the second assembling side.

16. The serial fan structure as claimed in claim 11, wherein the at least one male connector and the at least one female connector provided on each of the first and the second assembling side are located in the vicinity of four corners of the first and of the second assembling side.

17. The serial fan structure as claimed in claim 11, wherein the male connector is made of a material selected from the group consisting of a polymeric material, a carbon fiber material, and an elastic material.

18. The serial fan structure as claimed in claim 11, wherein the male connector is in the form of a barb.

19. The serial fan structure as claimed in claim 11, wherein the first and the second frame respectively have a rotary shaft supporting base and a blade assembly rotatably connected to the rotary shaft supporting base.

* * * * *